US007431604B2

(12) United States Patent
Waters et al.

(10) Patent No.: US 7,431,604 B2
(45) Date of Patent: Oct. 7, 2008

(54) CLAMSHELL STYLE HOLDING PART

(75) Inventors: Colin Waters, Santa Susana, CA (US); Dave Downey, Kalamazoo, MI (US)

(73) Assignee: TMB, Pacoima, CA (US)

( * ) Notice: Subject to any disclaimer, the term of this patent is extended or adjusted under 35 U.S.C. 154(b) by 0 days.

(21) Appl. No.: 11/582,139

(22) Filed: Oct. 16, 2006

(65) Prior Publication Data

US 2007/0093136 A1 Apr. 26, 2007

Related U.S. Application Data

(60) Provisional application No. 60/728,549, filed on Oct. 19, 2005.

(51) Int. Cl.
*H01R 13/625* (2006.01)

(52) U.S. Cl. ..... 439/344; 439/354

(58) Field of Classification Search ..... 439/447, 439/344, 136, 445, 610, 379, 354
See application file for complete search history.

(56) References Cited

U.S. PATENT DOCUMENTS 5,338,211 A * 8/1994 Kodama et al. ..... 439/135
5,462,457 A * 10/1995 Schroepfer et al. ..... 439/447
5,494,457 A * 2/1996 Kunz ..... 439/447
5,538,438 A * 7/1996 Orlando ..... 439/344
5,685,731 A * 11/1997 Lin ..... 439/344
5,685,736 A * 11/1997 Lung ..... 439/447
5,993,237 A * 11/1999 Kern et al. ..... 439/344
6,174,190 B1 * 1/2001 Tharp et al. ..... 439/352
6,250,951 B1 * 6/2001 Milner et al. ..... 439/460
6,866,532 B1 * 3/2005 Huang ..... 439/344
7,086,891 B2 * 8/2006 Liao ..... 439/418
2005/0106918 A1 * 5/2005 Colantuono et al. ..... 439/290
2005/0208816 A1 * 9/2005 O'Connor et al. ..... 439/344

* cited by examiner

*Primary Examiner*—Briggitte R Hammond
(74) *Attorney, Agent, or Firm*—Law Office SC Harris

(57) ABSTRACT

A clamshell type device which is adapted for use in strain relief. The clamshell surrounds the wire and also surrounds at least a part of the connector that attaches to the wire. The clamshell may press against the connector to hold to the connector and also may press against the wire. This provides strain relief. The outer surface of the clamshell device includes a part that still allows depression of the release mechanism from the connector.

2 Claims, 4 Drawing Sheets

CLAMSHELL STYLE HOLDING PART

CROSS-REFERENCE TO RELATED APPLICATIONS

This application claims priority to U.S. Application Ser. No. 60/728,549, filed on Oct. 19, 2005. The disclosure of the prior application is considered part of (and is incorporated by reference in) the disclosure of this application.

BACKGROUND

Many different forms of connectors are known for use with wires. Some of these connectors are attached to the end of a wire, and crimped on. The crimp, that is usually a pressure or other kind of connection between the elements of the wire and the elements of the connector itself, hold the wire and the connector together.

Strain relief may be used in certain types of wires, so that pulling on the wire does not correspondingly cause the wire to be removed from the connector. However, in many connectors, there is simply no adequate method of strain relief.

For example, many network connectors, such as those used with RJ 45 type connections, allow all strain relief to simply be done by the connection between the connector and the wire. This makes it possible for the wire to fail in various ways, e.g., especially when the wire is used in a high stress situation.

SUMMARY

The present application describes a special kind of strain relief device, intended for use with certain kinds of connector-wire interfaces. The strain relief is formed of a so-called clamshell. That clamshell provides a connection between the outer sheath of the wire, and the connector itself. By so doing, that clamshell provides an improved strain relief. This system may be used, for example, with a wire connection, such as an RJ-45 type wire connection.

BRIEF DESCRIPTION OF THE DRAWINGS

These and other aspects will now be described with reference to the accompanying drawings, wherein.

DETAILED DESCRIPTION

The general structure and techniques, and more specific embodiments which can be used to effect different ways of carrying out the more general goals are described herein.

Figure 1:
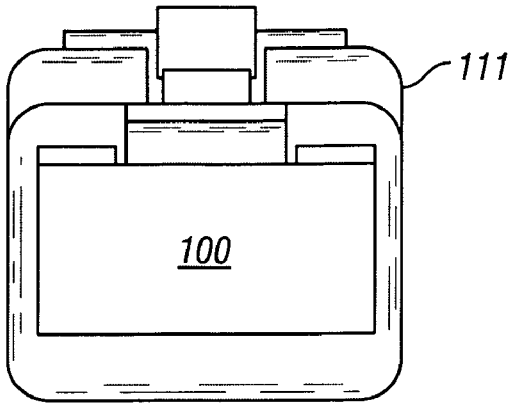
FIG. 1 shows a view of the connector, showing the radius connection of the connector.
Figure 2:
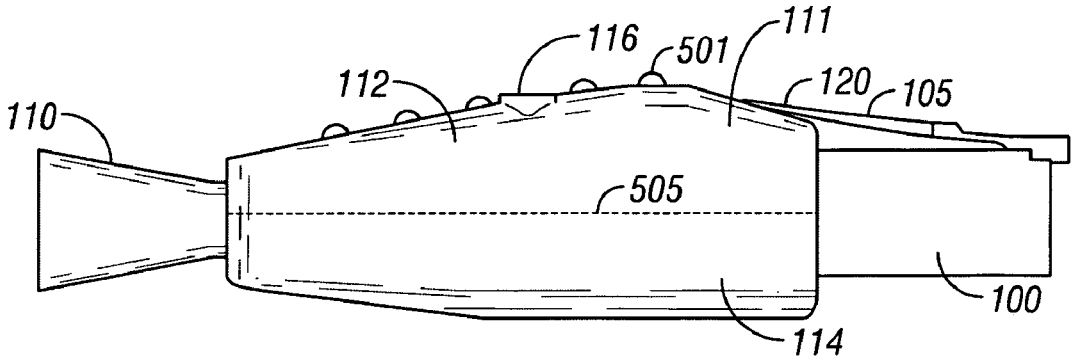
FIG. 2 shows a side view of the clamshell connection.
Figure 3:
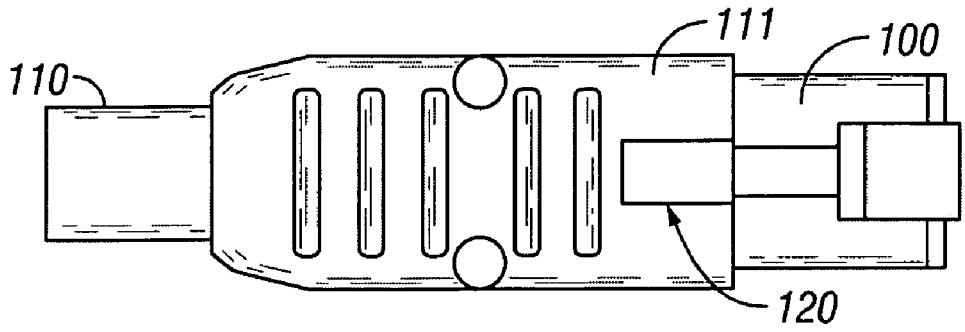
FIG. 3 shows a top view of the clamshell.

FIGS. 1-3 show an embodiment. In the embodiment, a connector 100, which is intended to connect to a network connection, is connected to a cable 110. The connector 100 may be an RJ 45 type, and the cable 110 may be a conventional cat 5 type ethernet cable. There are eight wires in the cat 5 cable that are connected to the RJ-45 connector. However, it should be understood that there may be different numbers of wires being used, and that fewer or more wires may be used depending on special aspects of the connector.

The wires from cable 110 are connected to contacts within the connector 100, as conventional. A special strain relief housing 111 is used to connect to both the outer surface of the cable 110 and to the outer surface of the connector 100. The housing has a two-part clamshell type layout. The housing is formed of a top portion 112, and a bottom portion 114. The top and bottom portions are connected by screws 116 which hold the top portion into the bottom portion. The top portion and bottom portion may be tightened to one another against both the connector 100 and the cable 110. The housing also includes internal ribs that provide an additional grip on the connector, and may also provide an additional grip on the wire. The housing may also will alternatively include an internal crimp, which provides an additional connection to the wire. The crimping should avoid being so tight that it would injure the Cat5 cable.

In one aspect, the housing may be made of the same material as the connector.

An important aspect may be sizing a clamshell device carefully so that it may fit in standard network patch bays. FIG. 2 also shows that the clamshell housing includes an indentation area 120 therein. That indentation area may include an indented portion, adjacent to where the connector 100 includes its release tab 105. The release tab 105 typically connects into the ethernet bay, and holds the connector in place. It is necessary to depress portion 105 in order to remove the connector. An indentation area 120 is provided to enable depressing that portion 105.

The dimensions of the clamshell are, as described, specifically maintained in order to ensure proper fit and function in standard network patch bays. This may include a standard with a 0.551 inches, a maximum height of 0.649 inches, and a maximum cable crimp of 0.2 inches. The screws 116 may be high-low style screws size 5-22, using 0.099 inch pilot holes.

The housing 111 includes internal ribs such as 211, which are staggered in order to hold the cable's outer surface. In the shown embodiment, there may be three different ribs 211, 212, and 213. The screw connection may be at the area 214, so that a maximum amount of pressure is applied at the cable end of the clamshell.

The connector end of the clamshell, connects to the top and bottom of the connector to hold directly against the connector.

The wire is maintained in place. The wire enters through wire entrance location, and is further constricted by the constrictions 301, 302 which compress and hold against the wire. The wire is thinner adjacent the ribs 302, as compared to its thickness when it enters, near 300. That is, the wire is further compressed at the area near 302, as compared with the area that it enters.

The clamshell also includes areas which hold against the connector portion.

FIG. 1 shows a front on view of the connector and clamshell, with the connector 100 shown attached to the clamshell housing 111. In an embodiment, the housing is radiused at all edges, so that it provides no sharp edges, and may provide an additional ergonomic surface. The view of the housing shown in FIG. 2 shows additional ergonomic surfaces, and FIG. 3 shows a top view of these surfaces. Note that the top portion of the housing 111 includes a plurality of bumps 501. These bumps are provided to facilitate holding the housing, thereby facilitating insertion and removal of the connector from a connector bay. It may be easier to hold the connector in this way. The bumps may also facilitate holding the clamshell. The clamshell also includes a plurality of different radiused portions. Relative to the center line 505, the first portion forms an 11.5° area, the second portion forms an 16.9° area, the third portion forms a 7.5° area. The rear surface is also rounded, again to provide ergonomic surfaces. The rounded surface may have a 13° radius relative to the centerline.

Figure 4:
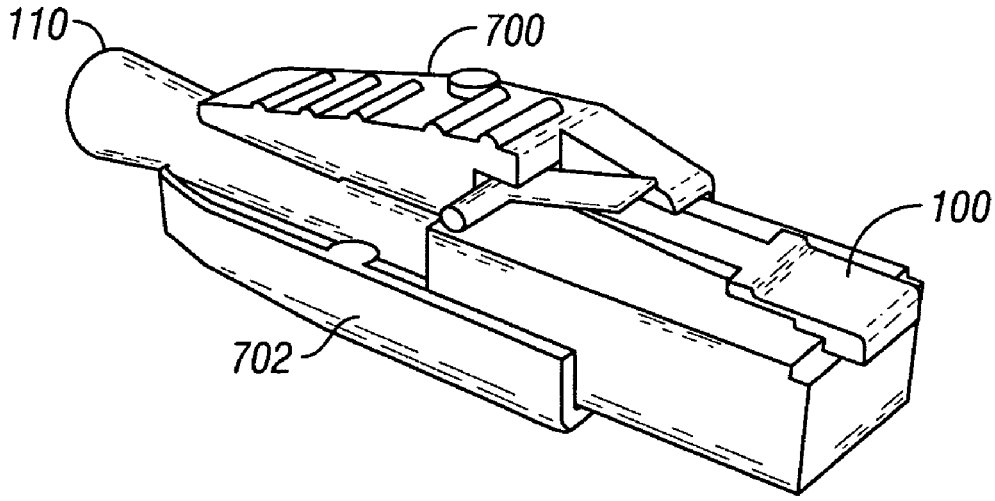
FIG. 4 shows a plan view of the outer housing of the clamshell.

A second embodiment is shown in FIG. 4, and this embodiment causes the top portion to press further against the bottom portion. In the FIG. 4 embodiment, the top portion of the clamshell 700 presses against the bottom portion of the clamshell 702, to press against the wire 100. The connection to the connector is much the same, except that the top portion of the connector, where the lever is located, leaves further room for the lever movement.

Figure 5:
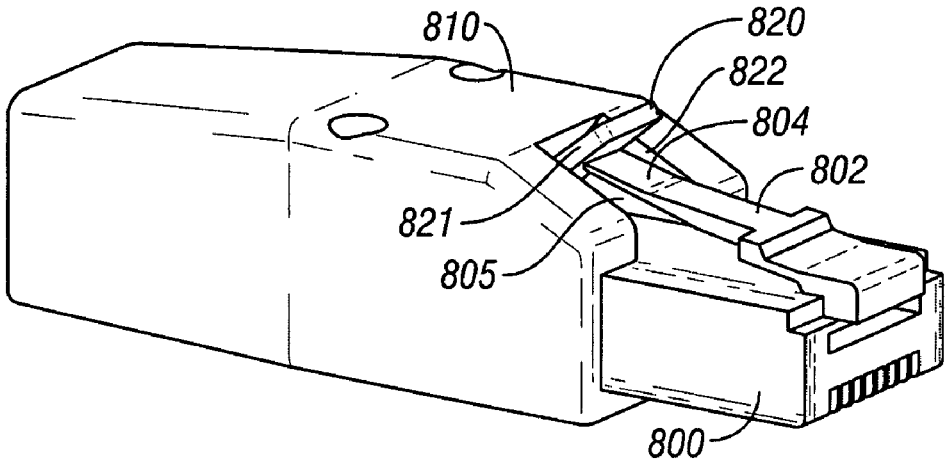
FIG. 5 shows a view of an additional embodiment which includes a part for releasing the locking mechanism.

When attaching the strain relief device, the front surface of the housing of the clamshell part may actually block access to the release tab on the RJ-45 connector. FIG. 5 shows an embodiment which addresses this problem. According to this embodiment, the RJ-45 connector 800 includes a release mechanism 802 which is depressed to release the connector 800 from its connection, when necessary. The clamshell part 810 covers a rear portion of the RJ-45 connector housing, and in so covering it, obstructs at least a portion 804 of the release mechanism from fully depressing. It might be possible to fully depress that release mechanism, for example, by forcing a portion of the user's finger or a tool into the recess area 805 that is defined within that portion of the clamshell housing 810.

In this embodiment, a supplemental depression part 820 is used to press against the depression mechanism 802. The depression part 820 can move in the direction of the arrows 821 shown in FIG. 8. It is spring biased into the uppermost position by the spring force of the depression mechanism. In that position, the portion 804 of the releasing mechanism 802 is high enough to allow the connector to be locked into a mating connector. The device can also be depressed, thereby depressing the bottom surface 822 of the device 820 against the surface 804, pressing down the releasing mechanism, and thereby enabling the device to be removed from the corresponding connector.

Figure 6A:
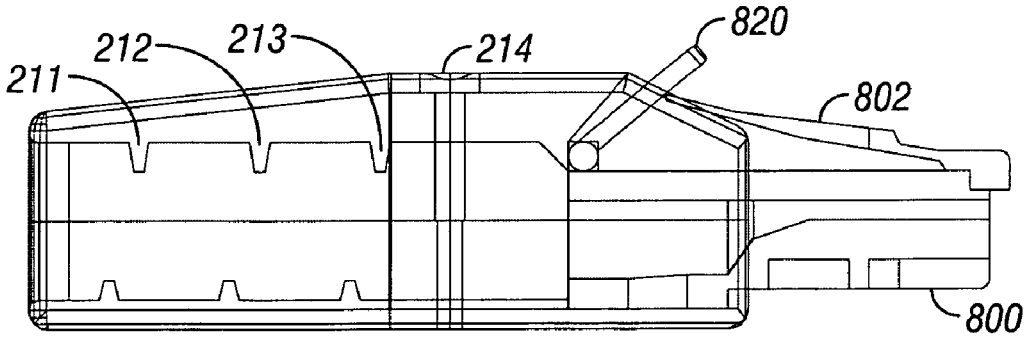
FIGS. 6*a*-6*c* show respectively side, top and cutaway views of the additional embodiment.
Figure 6B:
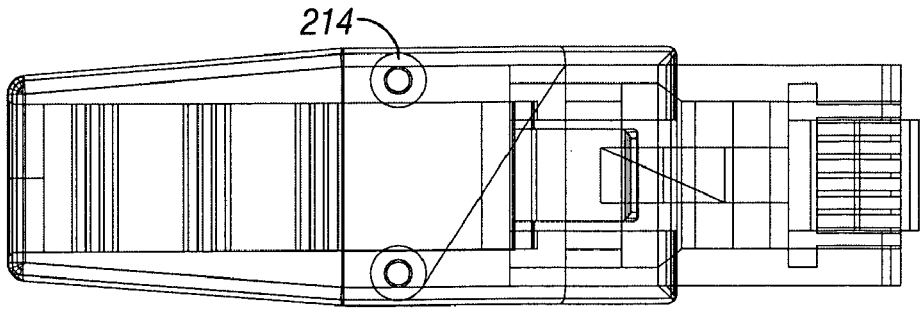
Figure 6C:
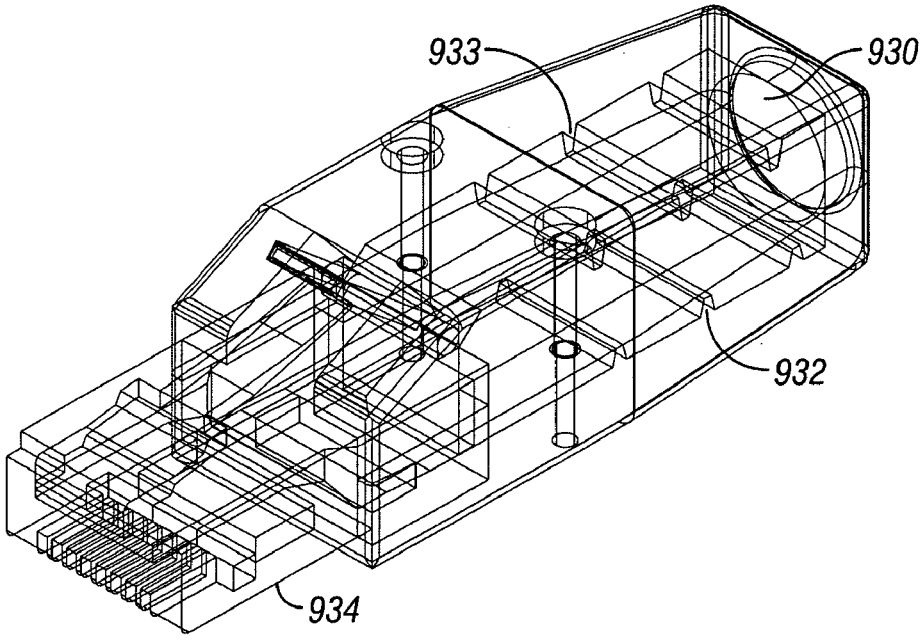

FIG. 6A shows a side view of the clamshell part and the RJ-45 connector for both embodiments. FIG. 6B shows a top view, and FIG. 6C shows a cutaway view showing the internal channel 930 through which the cable extends, the ribs 932 and 933 which press against the internal wire, and the connector 934.

The general structure and techniques, and more specific embodiments which can be used to effect different ways of carrying out the more general goals are described herein.

Although only a few embodiments have been disclosed in detail above, other embodiments are possible and the inventor intends these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example, other types of connectors may be used.

Also, the inventor intends that only those claims which use the words "means for" are intended to be interpreted under 35 USC 112, sixth paragraph. Moreover, no limitations from the specification are intended to be read into any claims, unless those limitations are expressly included in the claims.

What is claimed is:

1. A device, comprising:

a connector covering portion, formed of a top portion and a bottom separable portion, defining an inner cylindrical chamber between the top portion and a bottom portion, said inner cylindrical chamber including inwardly facing ribs therein, and sized to hold a cable, and an inner rectangular portion sized to hold a portion of an RJ-45 connector therein, and said connector covering portion having an outer surface which covers a rear portion adjacent a release mechanism of said RJ-45 connector, said outer surface of said connector covering portion sized in a way that prevents access to said release mechanism and prevents depression of said release mechanism, and a depressing portion which defines a supplemental depression part that presses against the release mechanism of the RJ-45 connector, wherein said depressing portion is biased into its uppermost position by a spring force of the depression mechanism, but can be depressed.

2. A method, comprising:

locating a two-part clamshell device around an outer sheath of a wire that holds an ethernet cable to form a strain relief part, and around a portion of a connector that is connected to said wire, where said connector is of a type that requires a removal part to be depressed in order to remove said connector from its connected socket, and wherein said clamshell device is located in a way that prevents said removal part from being depressed;

and operation of a supplemental depression part that is connected to said clamshell device, by moving said supplemental depression part to an area to depress said removal part allowing said supplemental depression part to be depressed even when the strain relief device is around the cable and around the connector, wherein said housing blocks depression of said locking lever, and further comprising a supplemental depression mechanism, movably coupled to said outer surface, and movable between a first position which does not depress the locking lever of said connector, and a second position which does depress the locking lever of said connector; and further comprising a spring part that spring biases said supplemental depression mechanism into said first position.

* * * * *